US006032297A

United States Patent [19]

Barthold et al.

[11] Patent Number: 6,032,297

[45] Date of Patent: Mar. 7, 2000

[54] HEAD-PROTECTIVE HELMET AND ASSEMBLIES THEREOF

[75] Inventors: Michael J. Barthold, Flemington; Louis Orotelli, Washington Township, both of N.J.

[73] Assignee: Cairns & Brother Inc., Clifton, N.J.

[21] Appl. No.: 08/886,786

[22] Filed: Jul. 1, 1997

[51] Int. Cl.[7] ..... A42B 3/14

[52] U.S. Cl. ..... 2/416; 2/418; 2/5

[58] Field of Search ..... 2/410, 411, 416, 2/417, 418, 419, 420, 421, 5, 8, 9, 414, DIG. 11; 24/453, 583, 587, 711.1

[56] References Cited

U.S. PATENT DOCUMENTS

| | | | |
|---|---|---|---|
| 3,156,922 | 11/1964 | Anderson | 2/419 |
| 3,286,275 | 11/1966 | Marchello | 2/411 |
| 3,354,468 | 11/1967 | Bowers, Jr. . | |
| 3,383,705 | 5/1968 | Raschke | 2/416 |
| 3,388,405 | 6/1968 | Simpson et al. . | |
| 4,263,679 | 4/1981 | Erlendson | 2/421 |
| 4,304,009 | 12/1981 | Nesbitt et al. | 2/416 |
| 4,527,290 | 7/1985 | Zahn | 2/416 |
| 4,888,831 | 12/1989 | Oleson | 2/420 |
| 5,044,019 | 9/1991 | Shewchenko et al. | 2/421 |
| 5,079,780 | 1/1992 | Coombs et al. | 2/420 |
| 5,150,479 | 9/1992 | Oleson | 2/414 |
| 5,412,811 | 5/1995 | Hildenbrand et al. | 2/10 |
| 5,517,691 | 5/1996 | Blake | 2/5 |
| 5,619,754 | 4/1997 | Thurwanger et al. | 2/418 |

*Primary Examiner*—Michael A. Neas
*Attorney, Agent, or Firm*—R. Gale Rhodes, Jr.

[57] ABSTRACT

Head-protective helmet including an outer shell, an impact cap, an inner shell, a head band, and mounting members mounting the head band to the inner shell. An assembly including the inner shell head band and mounting members mounting the head band to the shell. An assembly including the impact cap, the inner shell, cradle or web of head straps, head band, and mounting members mounting the head band to the inner shell. A mounting member or anchor clip particularly useful for mounting a head band to an inner shell.

54 Claims, 4 Drawing Sheets

HEAD-PROTECTIVE HELMET AND ASSEMBLIES THEREOF

BACKGROUND OF THE INVENTION

This invention relates generally to a new and improved head-protective helmet and more particularly relates to a new and improved head-protective helmet which may be embodied as a firefighter's helmet, a head-protective helmet for EMS personnel, firemen, policemen, and the like.

By way of example, firefighters' helmets are known to the prior art which include a relatively rigid outer shell, a compressible inner impact cap or inner impact attenuation liner or shell for absorbing or attenuating at least a portion of the force or energy produced upon a falling object striking the helmet and which is mounted to the interior of the outer shell, a cradle or web of head straps which extends into the inner impact cap and which is for engaging the head of a wearer of the helmet, and a head band for being fitted to the head of a wearer of the helmet. Such a firefighter's helmet is disclosed in U.S. Pat. No. 4,286,339 entitled FIREMAN'S HELMET WITH ENERGY ABSORBING LINER, patented Sep. 1, 1981, Peter A. Coombs inventor; this patent is incorporated herein by reference as if fully reproduced herein. The firefighter's helmet disclosed in this patent includes an outer shell 10 in which is mounted an inner compressible non-resilient foam liner 20, sometimes referred to in the art as an inner impact cap or shell, a head band 40 attached to the liner by an adjustable system of holes and snap buttons 44, 45 on tab extensions 46, and a cradle of head web straps 32–33 mounted to the inner impact liner or cap 20 by a tube 25. A chin strap 16 is mounted to the outer shell 10 as shown in FIG. 1.

Another firefighter's helmet including in the above-noted firefighter helmet components is disclosed in U.S. Pat. No. 5,044,016 entitled PROTECTIVE HELMET ASSEMBLY INCLUDING RELEASABLE HEAD RETAINING ASSEMBLY, patented Sep. 3, 1991, Christopher E. Coombs inventor; this patent is incorporated herein by reference as if fully reproduced herein. The helmet components of the firefighter's helmet disclosed in this patent are mounted together and function in substantially the same manner as the elements of the firefighter's helmet disclosed in the above-referenced U.S. Pat. No. 4,286,339 patent, except that additionally a plurality of retaining clip members 70 are mounted to the brim of the outer shell 12 and engage the rim 42 of the foam liner or inner impact cap or shell 38 to mount and maintain the inner impact cap within the outer shell below a predetermined load exerted on the inner impact cap or shell by the head straps engaging the user's head due to a blow or load being applied to the outer shell. The helmet disclosed in this patent includes an adjustable head band 32 lined with a sweat band 34; the head band 32 is attached to the foam liner or impact cap 38 by an adjustable system of holes 36 and snap buttons 38. The head-protective helmet disclosed in this patent further differs from the head-protective helmet disclosed in the U.S. Pat. No. 4,286,339 patent in that the chin strap (note the chin strap assembly indicated by general numerical designation 22) is mounted not to the outer shell but instead is mounted to the inner impact cap by the tube member 44 inset in the groove 46 formed in the outer surface of the foam liner or inner impact cap 38. Thus, by mounting the chin strap to the inner impact cap or liner 38 instead of the outer shell 12, upon the above-noted predetermined load being exerted on the inner impact cap or shell, such as for example upon the fireman falling through a hole in the floor with the outer brim of the outer shell catching on the edge of the hole, the fireman is not hanged by the chin strap and upon the retaining clip members 70 releasing, the outer shell and inner impact cap are separated and the inner impact cap remains on the fireman's head providing at least some further head protection.

As taught in detail in the above-referenced patents, the inner impact cap or foam liner and the manner of mounting the cradle or web of head straps to the inner impact cap or shell attenuate or absorb impact energy or force which could be transferred to the wearer's head upon, for example, an object striking the outer shell.

This invention also relates to assemblies, or sub-assemblies, for head-protective helmets and which assemblies permit head-protective components such as the inner impact cap or shell, head band and inner liner to be replaced individually or separately upon becoming damaged or broken.

This invention also relates to a mounting member particularly useful for mounting a head band to an inner liner or shell contained in a head-protective helmet.

SUMMARY OF THE INVENTION

A head-protective helmet embodying the present invention may include an outer shell, an impact cap or shell mounted in the outer shell, an inner shell or liner mounted in the impact shell, a head band, and mounting members for mounting the head band directly and solely to the inner shell.

An assembly embodying the present invention and adapted to be received within an impact cap or shell residing in an outer shell of a head-protective helmet may include a shell or inner liner, a head band, and mounting members mounting the head band directly and solely to the shell or inner liner.

An assembly embodying the present invention and adapted to be received within an outer shell of a head-protective helmet may include an impact cap or shell adapted to be received and mounted in the outer shell, an inner shell or liner adapted to be received and mounted in the impact cap or shell, a cradle or web of head straps, a head band and mounting members mounting the head band directly and solely to the inner shell or liner.

A mounting member embodying the present invention and particularly useful as an anchor clip for mounting a head band of a head-protective helmet to the inner shell or liner of the head-protective helmet may include first and second generally parallel and spaced apart portions interconnected by an integrally formed and substantially perpendicular member, the second portion being provided with a split snap button.

DESCRIPTION OF THE PREFERRED EMBODIMENTS

Figure 1:
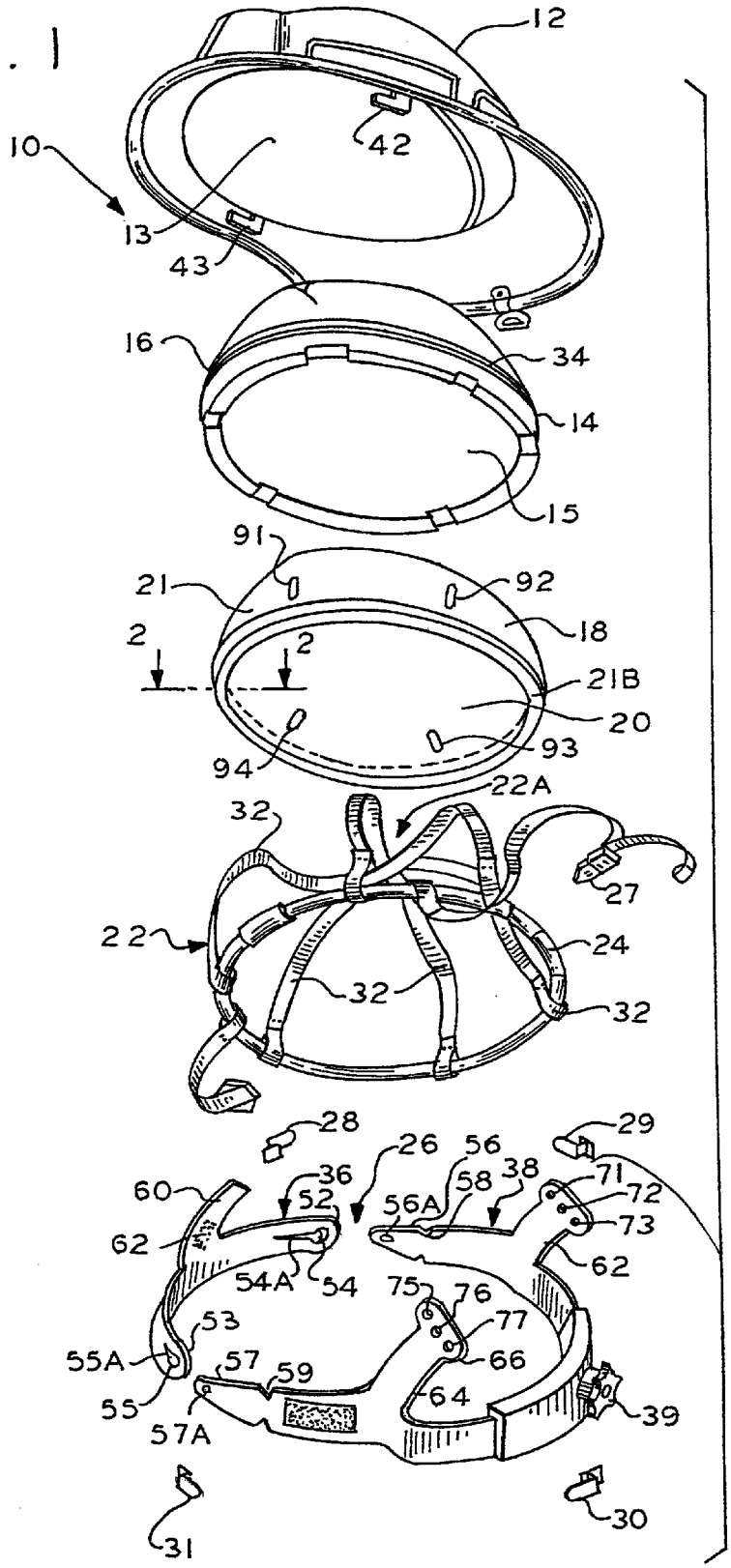
FIG. 1 is an exploded view of the components of the head-protective helmet of the present invention with the components being shown in perspective.
Figure 2:
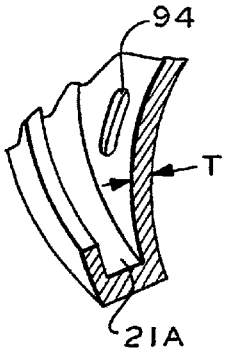
FIG. 2 is a partial cross-sectional view of the lower or outer peripheral portion of the inner liner or shell shown in FIG. 1 taken generally along the line 2—2 in FIG. 1.

The preferred embodiment of the head-protective helmet of the present invention shown in the drawings and described herein is that of a firefighter's helmet, but it will be understood that the present invention is not so limited and that the disclosure of a firefighter's helmet is merely by way of example. Referring now to FIG. 1, a firefighter's helmet is shown in exploded view embodying the present invention and indicated by general numerical designation 10. Fire fighter's helmet 10 includes a relatively rigid outer shell 12 having an interior 13; an inner impact cap or shell 14 having an exterior complementary in shape to the interior of the outer shell and having an interior 15 and including or terminating in a lower or outer peripheral portion 16; relatively rigid inner liner 18 having an exterior complementary in shape to the interior of the impact shell 14 and having an interior 20 and terminating in a lower or outer peripheral portion 21 providing, as may be better seen in FIG. 2, an outwardly extending generally annular channel 21A for receiving the outer peripheral portion 16 of the impact shell 14; a cradle or web of head straps indicated generally by general numerical designation 22; and a head band indicated by general numerical designation 26 and a plurality of head band mounting anchor clips 28, 29, 30 and 31 for mounting the head band 38 to the inner liner 18 as described in detail below.

The cradle or web of head straps 22 includes a plurality of individual head straps 32 stitched together at their central apex portion indicated by general numerical designation 22A and which individual head straps have their lower portions looped around a relatively thick walled fairly rigid tube 24 of, for example, resilient plastic such as polyethylene. The impact cap or shell 14 is provided on its exterior with an inwardly extending encircling annular groove 34 for receiving the tube 24 of the cradle straps 22 to mount the cradle of straps to the inner impact cap or shell 14; an adjustable chin strap including chin strap components 25 and 27 is mounted to the tube 24 whereby the chin strap also is mounted to the inner impact cap or shell 14. The head band 26 includes a forehead portion indicated by general numerical designation 36 and a nape device indicated by general numerical designation 38. Nape device 38 includes a rotatable ratchet knob 39 of the type known to the art for being rotated to vary the length of the nape device 38 and thereby the length of the head band 26 to fit the head band to the individual forehead and nape of the head of a wearer of the helmet 10; the forehead portion 36 and nape device 38 are shown in their disassembled state in FIG. 1. The outer shell 12 is provided with a plurality of retaining clips 40 and 42.

It will be understood, and referring again to FIG. 1, that in the head-protective helmet 10 of the present invention the outer shell 12, inner impact cap or shell 14, inner liner or shell 18, cradle or web of straps 22 and ring or tube 24, and retaining clip members 40 and 42 provided on the outer shell 12, may have the same structure as, or at least substantially the same structure as, perform the same function as, or at least substantially the same function as, respectively, the outer shell 12, inner impact cap or shell 38, cradle or web of straps 28, tube 44 and retaining clip members 70 disclosed in the U.S. Pat. No. 5,044,016 patent incorporated hereinabove by reference.

Figure 3:
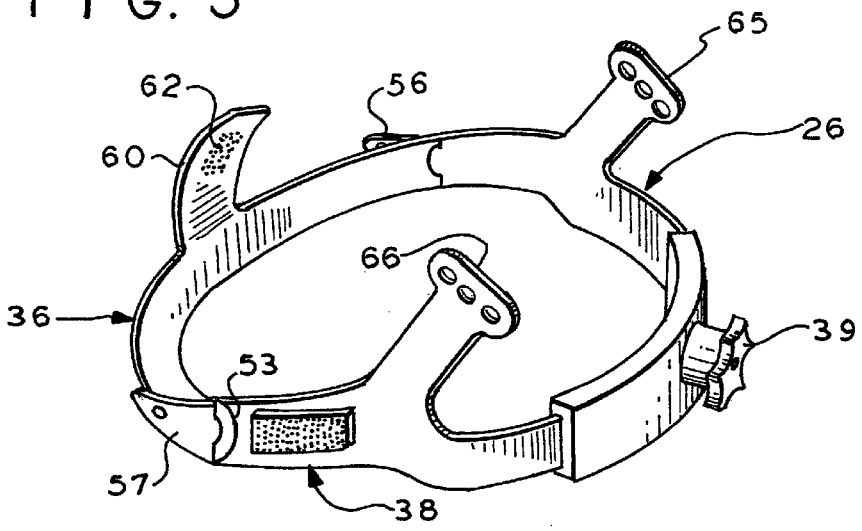
FIG. 3 is a perspective view of the head band showing the component forehead portion and nape device assembled.

Specific reference is now made to the structure and assembly of the forehead portion 36 and nape device 38 cooperatively providing the head band 26. The generally semi-circular forehead member or portion 36, FIG. 1, includes inner ends 52 and 53 provided, respectively, with circular openings 54 and 55, and the generally semi-circular nape device 38 includes pointed or triangular inner ends 56 and 57 which are inserted into the circular openings 54 and 55 to mount the forehead portion 36 and the nape device 38 together and pivotally with respect to each other. More specifically, the forehead portion inner ends 52 and 53 also are provided, respectively, with slits or slots 54A and 55A opening into the circular openings 54 and 55 and the inner triangular ends 56 and 57 of the nape device are aligned or oriented substantially co-planar with the slots 54A and 55A and inserted therethrough and then rotated to align the nape device 38 generally circularly with respect to the forehead portion 36 and to complete the assembly of the head band 26. The inner ends 56 and 57 of the nape device 38 are provided with notches or reduced thickness portions or indentations 58 and 59 for receiving the outer ends 52 and 53 of the forehead portion 36 which facilitates mounting of the forehead portion 36 and the nape device 38 pivotally with respect to each other; the nape device inner ends 56 and 57 are also provided with split snap button receiving holes or openings 56A and 57A for, it will be generally understood, receiving the split snap button of the mounting members 28 and 31 to mount the nape device triangular ends 56 and 57 to the mounting members 28 and 31 and thereby to the inner liner or shell 18. The assembled forehead member 36 and nape device 38 are shown in FIG. 3 and are shown comprising the head band 26 upon assembly.

It will be generally understood that the reason the forehead portion 36 and nape device 38 of the head band 26 are mounted pivotally with respect to each other is to permit the head band to better fit the individual forehead and the nape of the head of a wearer of the helmet 10. More specifically, the forward portion of the forehead portion 36, FIG. 1, is provided with an upwardly extending tab or projection 60 provided on its exterior with one of a hook or loop patch 62 and it will be understood that although not shown in FIG. 1 the forward interior portion of the inner liner or shell 18 is provided with the other of a hook and loop patch. In use the forehead portion 36 is pivoted with respect to the nape device 38, and the hook or loop patch 62 is engaged with different portions of the loop or hook patch (not shown) provided on the forward interior portion of the inner liner or shell 18 to mount the forehead portion 36 at different heights with respect to the inner liner or shell 18 and thereby with respect to the forehead of a wearer of the helmet 10. The nape device 38 includes upwardly extending members 62 and 64 provided at the rearward portion of the nape device 38 and angularly disposed members 65 and 66 provided, respectively, at the ends of the members 62 and 64. It will be noted that the angular members 65 and 66 are provided, respectively, with split snap button receiving holes or three openings 71–73 and 75–77. From FIG. 1, it will be noted that these holes or openings are at different heights or levels, and it will be understood that these openings function in associated pairs, i.e. holes 71 and 75 are associated and function as a pair, holes 72 and 76 are associated and function as a pair, and holes 73 and 77 are associated and function as a pair. It will be generally understood that, in use, such associated pairs of holes receive the snap buttons provided respectively on anchor clips 29 and 30 to mount the angularly disposed members 65 and 66 to such anchor clips and thereby to the inner liner or shell 18.

Figure 4:
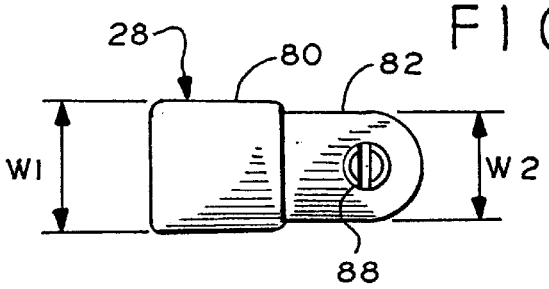
FIGS. 4–6 are, respectively, side, bottom and rear views of the mounting member or anchor clip of the present invention.
Figure 5:
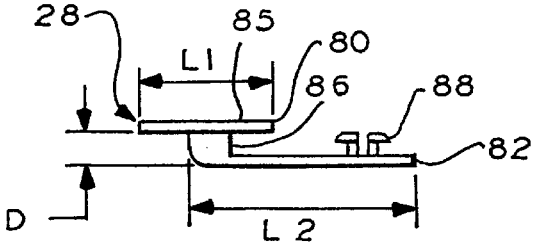
Figure 6:
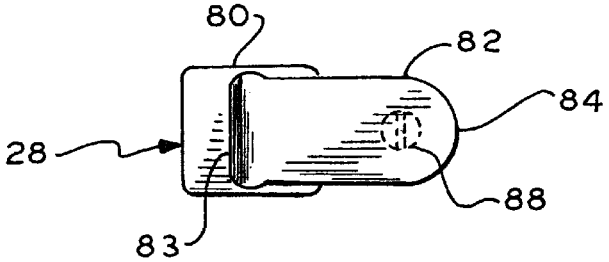
Figure 7:
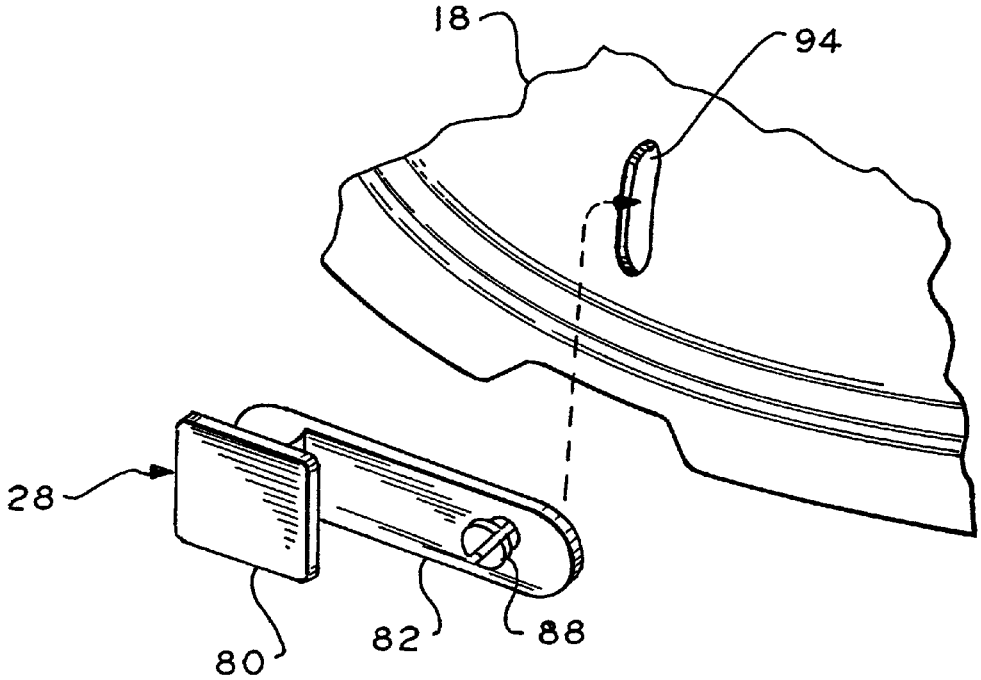
FIGS. 7 and 8 are diagrammatical illustrations showing the assembly or mounting of a mounting member or anchor clip to a portion of the inner liner or shell.
Figure 8:
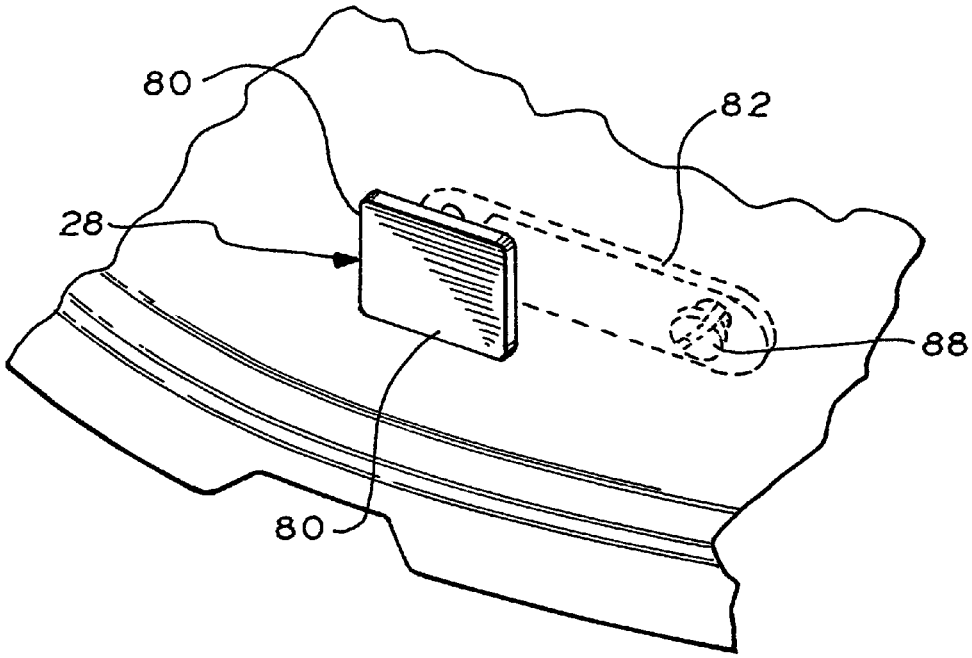

The detailed structure of representative mounting member or anchor clip 28 is shown in FIGS. 4-6. Representative mounting member or anchor clip 28 includes a first generally rectangular, planar portion 80 and a second generally rectangular planar portion 82 having a first shoulder or end 83 and a rounded second end 84. The first and second portions 80 and 82 are disposed substantially parallel and spaced apart as shown in FIG. 5. The first portion 80, FIG. 5, has a mid portion 85, FIG. 5, and the first and second portions 80 and 82 are interconnected by an integrally formed member 86 extending substantially perpendicular between the mid portion 85 of the first portion 80 and the first end 83 of the second portion 80. The interconnecting member 86, as shown in FIG. 5, spaces the first and second portions apart a distance D which is greater, it will be understood, than the thickness T of the inner liner or shell 18 shown in FIG. 2. The second end 84 of the second mounting member portion 82, note FIGS. 4 and 5, is provided with a split snap button 88 extending generally inwardly, as shown in FIG. 5, toward the first mounting member portion 80. It will be understood from FIGS. 4 and 5 that the first portion 80 has a width W1 which is greater than the width W2 of the second portion 82 and that the length L2 of the second portion 82 is greater than the length L1 of the first portion 80. The anchor clips 28–31, FIG. 1, are mounted to the inner liner or shell 18 using shell openings 91–94 shown in FIG. 1 extending through the inner liner or shell 18 with shell opening 94 being shown in detail in FIG. 2. As will be noted from FIG. 2 and representative shell opening 94, the shell openings are oblong with the longer dimension being oriented generally vertically as viewed in FIGS. 1 and 2. It will be further understood, and as illustrated in FIGS. 7 and 8, that the first portion 80 of representative mounting member or anchor clip 28 is larger than representative shell opening 94 and that the width W2 (FIG. 4) of the second portion 82 is less than the height of the shell opening 94 and that the combined thickness of the second portion 82 and the split snap button 88 is less than the width of the shell opening 84 whereby the second portion 82 of the mounting member 28 is inserted through the shell opening 94 with the first portion 80 of the mounting member 28, being larger than the shell opening 94, residing exteriorly of the inner liner or shell 80. It will be understood from FIG. 8 that upon the second portion and snap button 88 of the mounting member 28 residing and extending interiorly of the inner liner or shell 18, the snap button 88 extends towards the interior of the inner liner or shell 18. Since, as noted above, the distance D between the first and second portions of the mounting members provided by the interconnecting member 86 (note FIG. 5) is greater than the thickness T (note FIG. 2) of the inner liner or shell 18, a portion of the shell 18 surrounding the shell openings is received between the first and second mounting member portions.

The components shown in FIG. 1 and described above comprising an embodiment of the head-protective helmet of the present invention may be assembled as follows. The mounting members 28–31 are mounted to the inner liner or shell 18 as described above with regard to representative mounting member 28 shown in FIGS. 7 and 8, the inner impact cap or shell 14 is mounted over the inner liner or shell 18 with the lower peripheral portion 16 of the inner impact cap or shell 14 being inserted and received in the annular channel 21A provided on the inner liner or shell 18. The apex portion 22A of the cradle or web of head straps 22 is inserted into the interior 20 of the inner liner or shell 18 and the resilient tube 24 of the cradle or web of head straps 22 is expanded and fitted upwardly and over the lower portion of the inner impact cap or shell 14 and snap fitted into the annular channel 16 provided on the inner impact cap 18 with the lower portions of the head straps 32 being looped or passed over or around the lower peripheral edge 21B of the inner liner or shell 18. The forehead portion 36 and the nape device 38 are assembled to form the head band 26 as described above, and the head band 26 is mounted directly and solely to the inner shell or liner 18 by choosing a pair of associated holes formed in the triangular members 65 and 66 of the nape device 38 and by snap fitting the split snap buttons provided on mounting members 29 and 28 into such chosen pair of associated holes and by engaging the hook or loop patch 62 provided on the tab or projection 60 of the head band forehead portion 36 at a chosen height, as described above with the loop or hook patch (not shown) formed on the forward interior portion of the inner liner or shell 18.

Figure 9:
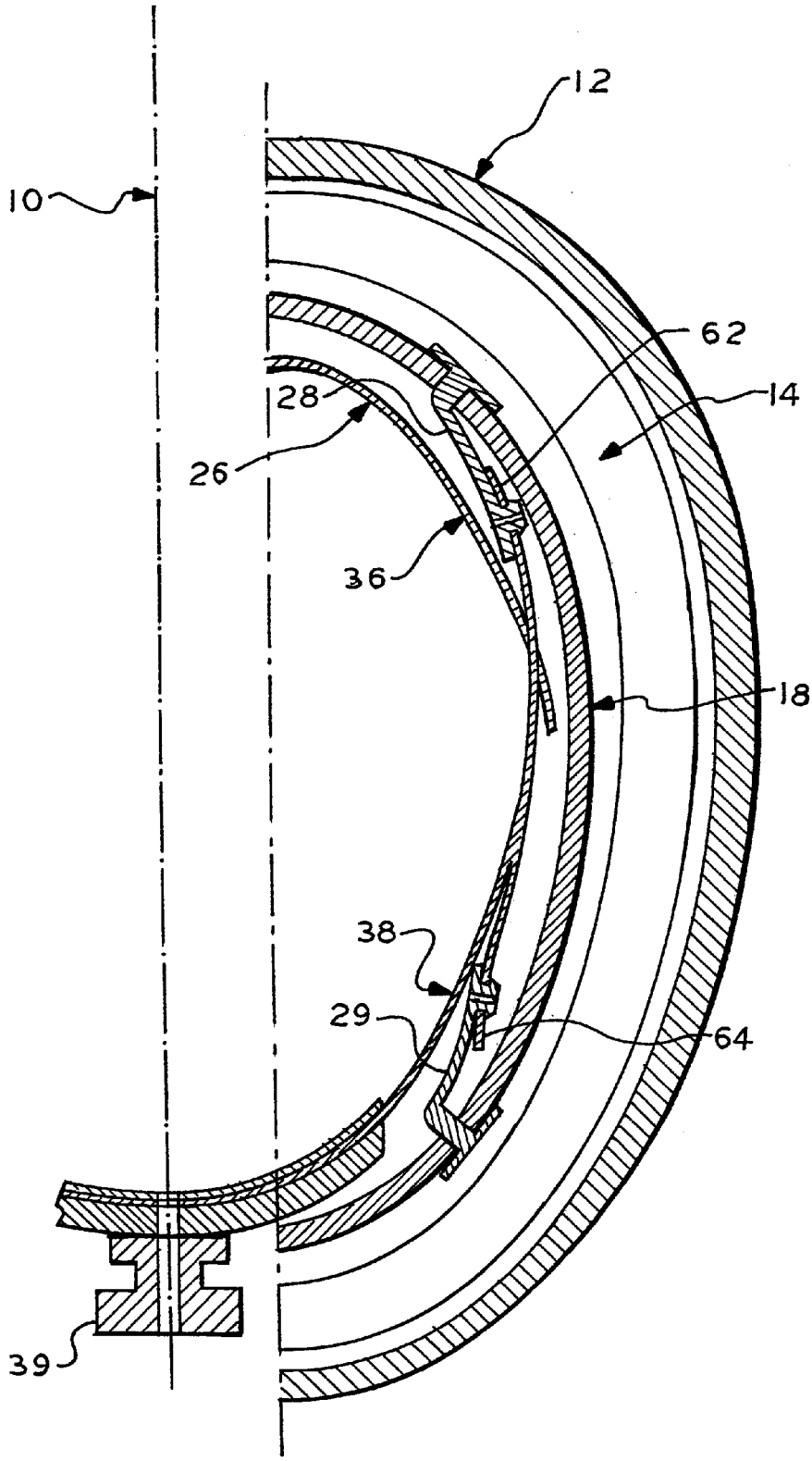
FIG. 9 is a partial transverse and diagrammatical cross-sectional view of the components of the head-protective helmet shown in FIG. 1 in their assembled condition.

The assembly of the inner impact cap 14, inner liner or shell 18, cradle or web of straps 22, and head band 26 is then inserted into the interior 13 of the outer shell 12, and the retaining clip members 40 and 42 are snapped or fitted over the lower peripheral edge 21B of the inner liner or shell 18 and the head-protective helmet 10 is fully assembled and ready for use. The components of the head-protective helmet 10 are partially shown in their assembled condition in FIG. 9. It will be understood that such head-protective helmet 10 comprises an embodiment of the head-protective helmet of the present invention.

It will be further understood that upon the head band 26 being assembled or mounted to the inner liner or shell 18 by the mounting members 28–31 as described above, the inner liner or shell 18, mounting members and head band 26 comprise an assembly or sub assembly of the present invention which may be used to replace the inner liner or shell 18, or head band 26, or a mounting member, upon any of these components being individually broken or damaged without the requirement that the entire head-protective helmet 10 be replaced or removed from service.

Similarly, upon the head band 26, mounting members 28–31, inner liner or shell 18, cradle or web of straps 22, and impact cap 14 being assembled as described above, such assembly comprises a further assembly, or sub assembly, of the present invention, permitting this assembly, or any component thereof, to be replaced individually and a new such assembly, or sub assembly, to be mounted to the outer shell 12.

Lastly, it will be understood that the mounting member or anchor clip shown in FIGS. 4-6 comprises the mounting member invention of the present invention.

With regard to material of which the components of the helmet 10 may be made, FIG. 1, the outer shell 12 may be made of suitable relatively rigid high temperature thermoplastic material such as Ultem available from General Electric Plastics and formed by suitable injection molding. The inner impact cap 14 may be made of suitable compressible, non-resilient material, such as rigid polyurethane foam of the type known to the art for protective helmet impact caps and formed by suitable reaction injection molding; the forehead portion 36 of the head band 26 may be made of suitable high density polyethylene and formed by suitable stamping; the nape device 38 of the head band 26 may be made of suitable Nylon available from DuPont and may be formed by injection molding; and the mounting members or anchor clips 28-31 may be made of Nylon available from DuPont and formed by suitable injection molding. The head straps 23 of the web or cradle 22 may be made of Nylon available from DuPont.

It will be understood by those skilled in the art that many variations and modifications may be made in the present invention without departing from the spirit and the scope thereof.

What is claimed is:

1. A head-protective helmet comprising:

an outer shell;

an impact shell mounted in said outer shell;

an inner shell mounted in said impact shell;

a head band, said head band including a forehead member and a nape device and wherein said forehead member and said nape device are mounted together directly and for pivotal movement with respect to each other; and mounting means for mounting said head band directly and solely to said inner shell.

2. The helmet according to claim 1 wherein said forehead member is generally semi-circular and includes inner ends provided with circular openings and wherein said nape device is generally semi-circular and includes triangular inner ends inserted into said circular openings to mount said forehead member and said nape device together directly and for pivotal movement with respect to each other.

3. The helmet according to claim 2 wherein said inner ends of said forehead member are provided with slots opening into said circular openings and which slots are for receiving said triangular inner ends of said nape device to facilitate insertion of said triangular inner ends into said circular openings.

4. The helmet according to claim 3 wherein said inner ends of said nape device are provided with indentations for receiving said inner ends of said forehead member to facilitate mounting of said forehead member and said nape device together directly and for pivotal movement with respect to each other.

5. The helmet according to claim 2 wherein said forehead member is provided with an outwardly extending tab provided with forehead member mounting means and wherein said inner shell has an interior provided with inner shell mounting means and wherein upon said forehead member being pivoted with respect to said nape device said forehead member mounting means and inner shell mounting means are engaged to mount said forehead member at different heights with respect to said inner shell.

6. The helmet according to claim 2 wherein said nape device includes a pair of outwardly extending members provided with a pair of angularly disposed members including nape device mounting means for engaging said mounting means to mount said nape device at different heights with respect to said inner shell upon said nape device being pivoted with respect to said forehead member.

7. The helmet according to claim 6 wherein said mounting means provide a plurality of split snap buttons and wherein said nape device mounting means comprise a plurality of associated pairs of openings at different heights with respect to each other and wherein said associated pairs of openings receive said split snap buttons to mount said nape device at different heights with respect to said inner shell.

8. The helmet according to claim 2 wherein said triangular inner ends of said nape device are provided with first nape device mounting means and wherein said nape device includes a pair of outwardly extending members provided with a pair of angularly disposed members including second nape device mounting means, said first nape device mounting means and said second nape device mounting means for engaging said mounting means to mount said nape device to said inner shell.

9. The helmet according to claim 8 wherein said mounting means provide a plurality of split snap buttons and wherein said first nape device mounting means and said second nape device mounting means comprise openings which receive such split buttons to mount said nape device to said inner shell.

10. The helmet according to claim 5 wherein said nape device includes a pair of outwardly extending members provided with a pair of angularly disposed members including nape device mounting means for engaging said mounting means to mount said nape device at different heights with respect to said inner shell upon said nape device being pivoted with respect to said forehead member.

11. The helmet according to claim 10 wherein said mounting means provide a plurality of split snap buttons and wherein said nape device mounting means comprise a plurality of associated pairs of openings at different heights with respect to each other and wherein said associated pairs of openings receive said split snap buttons to mount said nape device at different heights with respect to said inner shell.

12. The helmet according to claim 5 wherein said triangular inner ends of said nape device are provided with first nape device mounting means and wherein said nape device includes a pair of outwardly extending members provided with a pair of angularly disposed members including second nape device mounting means, said first nape device mounting means and said second nape device mounting means for engaging said mounting means to mount said nape device to said inner shell.

13. The helmet according to claim 12 wherein said mounting means provide a plurality of split snap buttons and wherein said first nape device mounting means and said second nape device mounting means comprise openings which receive such split buttons to mount said nape device to said inner shell.

14. The helmet according to claim 1 wherein said inner shell includes a lower portion providing an outwardly extending generally annular channel and wherein said impact shell includes a lower generally annular portion residing in said channel.

15. The helmet according to claim 7 wherein said inner shell is provided with a plurality of shell openings, wherein said mounting means comprise a plurality of anchor clips, each anchor clip comprising a first portion and a second portion, said first portion being larger than said shell openings to prevent said first portion from passing through said shell openings and to cause said first portion to reside exteriorly of said inner shell, and said second portion being of a size permitting said second portion to extend through said shell openings and reside interiorly of said inner shell and said second portion provided with one of said split snap buttons.

16. The helmet according to claim 15 wherein said inner shell has a thickness, wherein said first and second portions are generally planar, wherein said first portion has a length and a width and wherein said second portion has a length and a width and wherein said width of said first portion is greater than the width of said second portion and wherein the length of said first portion is less than the length of said second portion, and wherein said first and second portions are generally parallel and spaced apart a distance of greater than said thickness of said inner shell and wherein said first and second portions are interconnected by an integrally formed member extending substantially perpendicularly therebetween.

17. An assembly adapted to be received within an impact shell adapted to reside in an outer shell of a head-protective helmet, comprising:

a shell;

a head band, said head band including a forehead member and a nape device and wherein said forehead member and said nape device are mounted together directly and for pivotal movement with respect to each other; and mounting means mounting said head band directly and solely to said shell.

18. The assembly according to claim 17 wherein said forehead member is generally semi-circular and includes inner ends provided with circular openings and wherein said nape device is generally semi-circular and includes triangular inner ends inserted into said circular openings to mount said forehead member and said nape device together directly and for pivotal movement with respect to each other.

19. The assembly according to claim 18 wherein said inner ends of said forehead member are provided with slots opening into said circular openings and which slots are for receiving said triangular inner ends of said nape device to facilitate insertion of said triangular inner ends into said circular openings.

20. The assembly according to claim 19 wherein said inner ends of said nape device are provided with indentations for receiving said inner ends of said forehead member to facilitate mounting of said forehead member and said nape device together and pivotally with respect to each other.

21. The assembly according to claim 18 wherein said forehead member is provided with an outwardly extending tab provided with forehead member mounting means and wherein said shell has an interior provided with shell mounting means and wherein upon said forehead member being pivoted with respect to said nape device said forehead member mounting means and shell mounting means are engaged to mount said forehead member at different heights with respect to said shell.

22. The assembly according to claim 18 wherein said nape device includes a pair of outwardly extending members provided with a pair of angularly disposed members including nape device mounting means for engaging said mounting means to mount said nape device at different heights with respect to said shell upon said nape device being pivoted with respect to said forehead member.

23. The assembly according to claim 22 wherein said mounting means provide a plurality of split snap buttons and wherein said nape device mounting means comprise a plurality of associated pairs of openings at different heights with respect to each other and wherein said associated pairs of openings receive said split snap buttons to mount said nape device at different heights with respect to said shell.

24. The assembly according to claim 18 wherein said triangular inner ends of said nape device are provided with first nape device mounting means and wherein said nape device includes a pair of outwardly extending members provided with a pair of angularly disposed members including second nape device mounting means, said first nape device mounting means and said second nape device mounting means for engaging said mounting means to mount said nape device to said shell.

25. The assembly according to claim 24 wherein said mounting means provide a plurality of split snap buttons and wherein said first nape device mounting means and said second nape device mounting means comprise openings which receive such split buttons to mount said nape device to said shell.

26. The assembly according to claim 21 wherein said nape device includes a pair of outwardly extending members provided with a pair of angularly disposed members including nape device mounting means for engaging said mounting means to mount said nape device at different heights with respect to said shell upon said nape device being pivoted with respect to said forehead member.

27. The assembly according to claim 26 wherein said mounting means provide a plurality of split snap buttons and wherein said nape device mounting means comprise a plurality of associated pairs of openings at different heights with respect to each other and wherein said associated pairs of openings receive said split snap buttons to mount said nape device at different heights with respect to said shell.

28. The assembly according to claim 21 wherein said triangular inner ends of said nape device are provided with first nape device mounting means and wherein said nape device includes a pair of outwardly extending members provided with a pair of angularly disposed members including second nape device mounting means, said first nape device mounting means and said second nape device mounting means for engaging said mounting means to mount said nape device to said shell.

29. The assembly according to claim 28 wherein said mounting means provide a plurality of split snap buttons and wherein said first nape device mounting means and said second nape device mounting means comprise openings which receive such split buttons to mount said nape device to said shell.

30. The assembly according to claim 17 wherein said shell includes a lower portion providing an outwardly extending generally annular channel and wherein said impact shell includes a lower generally annular portion residing in said channel.

31. The assembly according to claim 23 wherein said shell is provided with a plurality of shell openings, wherein said mounting means comprise a plurality of anchor clips, each anchor clip comprising a first portion and a second portion, said first portion being larger than said shell openings to prevent said first portion from passing through said shell openings and to cause said first portion to reside exteriorly of said shell, and said second portion being of a size permitting said second portion to extend through said shell openings and reside interiorly of said shell and said second portion provided with one of said split snap buttons.

32. The assembly according to claim 31 wherein said shell has a thickness, wherein said first and second portions are generally planar, wherein said first portion has a length and a width and wherein said second portion has a length and a width and wherein said width of said first portion is greater than the width of said second portion and wherein the length of said first portion is less than the length of said second portion, and wherein said first and second portions are generally parallel and spaced apart a distance of greater than said thickness of said shell and wherein said first and second portions are interconnected by an integrally formed member extending substantially perpendicularly therebetween.

33. An assembly adapted to be received within an outer shell of a head-protective helmet, comprising:

an impact shell adapted to be received and mounted in the outer shell;

an inner shell adapted to be received and mounted in said impact shell;

a head band, said head band including a forehead member and a nape device and wherein said forehead member and said nape device are mounted together directly and for pivotal movement with respect to each other; and mounting means mounting said head band directly and solely to said inner shell.

34. The assembly according to claim 33 wherein said forehead member is generally semi-circular and includes inner ends provided with circular openings and wherein said nape device is generally semi-circular and includes triangular inner ends inserted into said circular openings to mount said forehead member and said nape device together and for pivotal movement with respect to each other.

35. The assembly according to claim 34 wherein said inner ends of said forehead member are provided with slots opening into said circular openings and which slots are for receiving said triangular inner ends of said nape device to facilitate insertion of said triangular inner ends into said circular openings.

36. The assembly according to claim 35 wherein said inner ends of said nape device are provided with indentations for receiving said inner ends of said forehead member to facilitate mounting of said forehead member and said nape device together directly and for pivotal movement with respect to each other.

37. The assembly according to claim 34 wherein said forehead member is provided with an outwardly extending tab provided with forehead member mounting means and wherein said inner shell has an interior provided with inner shell mounting means and wherein upon said forehead member being pivoted with respect to said nape device said forehead member mounting means and inner shell mounting means are engaged to mount said forehead member at different heights with respect to said inner shell.

38. The assembly according to claim 34 wherein said nape device includes a pair of outwardly extending members provided with a pair of angularly disposed members including nape device mounting means for engaging said mounting means to mount said nape device at different heights with respect to said inner shell upon said nape device being pivoted with respect to said forehead member.

39. The assembly according to claim 38 wherein said mounting means provide a plurality of split snap buttons and wherein said nape device mounting means comprise a plurality of associated pairs of openings at different heights with respect to each other and wherein said associated pairs of openings receive said split snap buttons to mount said nape device at different heights with respect to said inner shell.

40. The assembly according to claim 34 wherein said triangular inner ends of said nape device are provided with first nape device mounting means and wherein said nape device includes a pair of outwardly extending members provided with a pair of angularly disposed members including second nape device mounting means, said first nape device mounting means and said second nape device mounting means for engaging said mounting means to mount said nape device to said inner shell.

41. The assembly according to claim 40 wherein said mounting means provide a plurality of split snap buttons and wherein said first nape device mounting means and said second nape device mounting means comprise openings which receive such split buttons to mount said nape device to said inner shell.

42. The assembly according to claim 37 wherein said nape device includes a pair of outwardly extending members provided with a pair of angularly disposed members including nape device mounting means for engaging said mounting means to mount said nape device at different heights with respect to said inner shell upon said nape device being pivoted with respect to said forehead member.

43. The assembly according to claim 42 wherein said mounting means provide a plurality of split snap buttons and wherein said nape device mounting means comprise a plurality of associated pairs of openings at different heights with respect to each other and wherein said associated pairs of openings receive said split snap buttons to mount said nape device at different heights with respect to said inner shell.

44. The assembly according to claim 37 wherein said triangular inner ends of said nape device are provided with first nape device mounting means and wherein said nape device includes a pair of outwardly extending members provided with a pair of angularly disposed members including second nape device mounting means, said first nape device mounting means and said second nape device mounting means for engaging said mounting means to mount said nape device to said inner shell.

45. The assembly according to claim 44 wherein said mounting means provide a plurality of split snap buttons and wherein said first nape device mounting means and said second nape device mounting means comprise openings which receive such split buttons to mount said nape device to said inner shell.

46. The assembly according to claim 33 wherein said inner shell includes a lower portion providing an outwardly extending generally annular channel and wherein said impact shell includes a lower generally annular portion residing in said channel.

47. The assembly according to claim 39 wherein said inner shell is provided with a plurality of shell openings, wherein said mounting means comprise a plurality of anchor clips, each anchor clip comprising a first portion and a second portion, said first portion being larger than said shell openings to prevent said first portion from passing through said shell openings and to cause said first portion to reside exteriorly of said inner shell, and said second portion being of a size permitting said second portion to extend through said shell openings and reside interiorly of said inner shell and said second portion provided with one of said split snap buttons.

48. The assembly according to claim 47 wherein said inner shell has a thickness, wherein said first and second portions are generally planar, wherein said first portion has a length and a width and wherein said second portion has a length and a width and wherein said width of said first portion is greater than the width of said second portion and wherein the length of said first portion is less than the length of said second portion, and wherein said first and second portions are generally parallel and spaced apart a distance of greater than said thickness of said inner shell and wherein said first and second portions are interconnected by an integrally formed member extending substantially perpendicularly therebetween.

49. A head band comprising a generally semi-circular forehead member including inner ends provided with circular openings and a generally semi-circular nape device including triangular inner ends inserted into said circular openings to mount said forehead member and said nape device directly to each other and for pivotal movement with respect to each other.

50. The head band according to claim 49 wherein said inner ends of said forehead member are provided with slots opening into said circular openings and which slots are for receiving said triangular inner ends of said nape device to facilitate insertion of said triangular inner ends into said circular openings.

51. The head band according to claim 50 wherein said inner ends of said nape device are provided with indentations for receiving said inner ends of said forehead member to facilitate mounting of said forehead member and said nape device directly to each other and pivotally with respect to each other.

52. The head band according to claim 51 wherein said head band is for being mounted to a helmet including first mounting means, and wherein said forehead member is provided with an outwardly extending tab provided with second mounting means and wherein upon said forehead member being pivoted with respect to said nape device said first mounting means and second mounting means are engaged to mount said forehead member at different heights with respect to said helmet.

53. The head band according to claim 52 wherein said nape device includes a pair of outwardly extending members provided with a pair of angularly disposed members including third mounting means for engaging said first mounting means to mount said nape device at different heights with respect to said outer helmet upon said nape device being pivoted with respect to said forehead member.

54. The head band according to claim 53 wherein said first mounting means are provided with a plurality of outwardly extending split snap buttons and wherein said third mounting means comprise a plurality of associated pairs of openings at different heights with respect to each other and wherein said associated pairs of openings receive said split snap buttons to mount said nape device at different heights with respect to said helmet.

* * * * *